United States Patent [19]

Rezanka et al.

[11] Patent Number: 5,065,170

[45] Date of Patent: Nov. 12, 1991

[54] INK JET PRINTER HAVING A STAGGERED ARRAY PRINTHEAD

[75] Inventors: Ivan Rezanka, Pittsford, N.Y.; Yasuo Horino, Tokyo, Japan

[73] Assignee: Xerox Corporation, Stamford, Conn.

[21] Appl. No.: 542,053

[22] Filed: Jun. 22, 1990

[51] Int. Cl.[5] ..... B41J 2/05; B41J 2/165

[52] U.S. Cl. ..... 346/140 R; 346/1.1

[58] Field of Search ..... 346/140, 1.1

[56] References Cited

U.S. PATENT DOCUMENTS

| | | | |
|---|---|---|---|
| 4,144,537 | 3/1979 | Kimura et al. . | |
| 4,369,456 | 1/1983 | Cruz-Uribe et al. . | |
| 4,463,359 | 7/1984 | Ayata et al. | 346/140 X |
| 4,559,543 | 12/1985 | Toganoh | 346/140 |
| 4,571,599 | 2/1986 | Rezanka . | |
| 4,703,333 | 10/1987 | Hubbard | 346/140 |
| 4,745,414 | 5/1988 | Okamura et al. . | |
| 4,774,530 | 9/1988 | Hawkins . | |
| 4,829,324 | 5/1989 | Drake et al. | 346/140 |
| 4,853,717 | 8/1989 | Harmon et al. . | |
| 4,935,750 | 6/1990 | Hawkins | 346/140 |

FOREIGN PATENT DOCUMENTS 115863 7/1984 Japan .

*Primary Examiner*—Joseph W. Hartary
*Attorney, Agent, or Firm*—Oliff & Berridge

[57] ABSTRACT

A staggered array printhead, recording medium support and capping and/or maintenance assembly for use in an ink jet printer is described. Capping and maintenance of printhead sub-units of the staggered array is performed by self-positioning and aligning members located on a capping and/or maintenance member which is movably positioned on one side of a recording medium support. The printhead is located on an opposite side of the recording medium support, staggered openings being provided in the support to enable contact between the capping and/or maintenance members and front faces of the printhead subunits. Heat management of the printhead is provided by an ink manifold positioned over the printhead subunits. The manifold includes fingered portions which extend into spaces between the subunits. Assembly of a staggered array printhead is facilitated by the use of a high precision fixture having recesses for the receipt of printhead subunits.

38 Claims, 6 Drawing Sheets

INK JET PRINTER HAVING A STAGGERED ARRAY PRINTHEAD

BACKGROUND OF THE INVENTION

1. Field of the Invention

The present invention relates to an ink jet printer, and, more particularly, to an ink jet printer having a staggered array printhead and a recording medium support which is penetrated by printhead-contacting members.

2. Description of the Related Art

Ink jet printing systems can generally be divided into two types: one type using thermal energy to produce a vapor bubble in an ink filled channel that expels a drop of ink; or a second type using a piezoelectric transducer to produce a pressure pulse that expels a droplet from a nozzle.

Thermal ink jet printing systems use thermal energy selectively produced by resistors located in capillary-filled ink channels near channel terminating nozzles or orifices to vaporize momentarily the ink and form bubbles on demand. Each temporary bubble expels an ink droplet and propels it towards a recording medium. The printing system may be incorporated in either a carriage-type printer or a pagewidth type printer. The carriage-type printer generally has a relatively small printhead containing the ink channels and nozzles. The printhead is usually sealingly attached to a disposable ink supply cartridge and the combined printhead and cartridge assembly is reciprocated to print one swath of information at a time on a stationarily held recording medium, such as paper. After the swath is printed, the paper is stepped a distance equal to the height of the printed swath, so that the next printed swath will be contiguous therewith. The procedure is repeated until the entire page is printed. For an example of a carriage-type printer, refer to U.S. Pat. No. 4,571,599 to Rezanka. In contrast, the pagewidth printer has a stationary printhead having a length equal to or greater than the width of the paper. The paper is continuously moved past the pagewidth printhead in a direction normal to the printhead length and at a constant speed during the printing process. Refer to U.S. Pat. No. 4,463,359 to Ayata et al for an example of a pagewidth printhead. Refer to U.S. Pat. No. 4,829,324 to Drake et al (the disclosure of which is herein incorporated by reference) for other examples of pagewidth printheads.

Piezoelectric activated ink jet printing systems use a pulse generator which provides an electric signal. The signal is applied across crystal plates, one of which contracts and the other of which expands, thereby causing the plate assembly to deflect toward a pressure chamber. This causes a decrease in volume which imparts sufficient kinetic energy to the ink in the printhead nozzle so that one ink droplet is ejected onto a recording medium. Refer to U.S. Pat. No. 4,144,537 to Kimura et al for an example of a piezoelectric activated ink jet printer.

In the ink jet printing systems of the above-types, several problems have arisen which adversely affect the quality and performance of printing. Among these problems are 1) clogging of the printhead nozzles caused by ink drying therein due to non-use for a period of time; 2) adherence of dust to the nozzlecontaining face of the printhead due to the moisture of fluid ink around the nozzle; 3) leakage of ink from the nozzles; 4) bubbles and dust taken into the printhead nozzles as a result of external causes such as vibration imparted to the printhead and environmental change occurring around the printhead; and 5) contamination of the printhead nozzles when the printhead is not in use, such contamination being, for example, non-collapsing air bubbles.

Several approaches have been proposed which address the aforementioned problems.

U.S. Pat. Nos. 4,853,717 to Harmon et al and 4,782,026 to Rasmussen et al each disclose a service station for an ink jet printer comprising a pump for priming a printhead, a sled to actuate the service station and seal the printhead, and a wiping member for cleaning the printhead. The service station cleans clogged nozzles, covers the nozzles with a protective cap when not in use and wipes contaminants from the nozzles. The service station is used with a carriage-type printhead and is fixed at one end of travel of the printhead.

U.S. Pat. No. 4,369,456 to Cruz-Uribe et al discloses a cleaning device for writing heads of an ink jet printer. The apparatus comprises rotatable supply and takeup reels, a movable absorbent cleaning belt including a plurality of embossed elements and a plurality of openings for allowing printing on a paper medium. The cleaning apparatus performs its functions while the printhead remains stationary.

U.S. Pat. No. 4,745,414 to Okamura et al discloses a recovery device for an ink jet recorder, the recovery device having an ink suction member, a cap covering an ink discharge port, a vent cap and a wiping member for wiping the discharge port. The recovery device is used with a carriage-type printhead and is fixed at one end of travel of the printhead.

U.S. Pat. No. 4,774,530 to Hawkins discloses an ink jet printhead having an upper and lower substrate bonded together with an insulative layer sandwiched therebetween. The upper substrate is a channel plate having a plurality of nozzle-defining channels formed in its lower surface. The channel plate also includes an ink-supplying fill hole extending entirely therethrough form its upper to its lower surface to supply ink from a source to the nozzle-defining channels. The lower substrate is a heater plate having a plurality of resistive heater elements on its upper surface corresponding in number and position to the channels in the channel plate. The lower surface of the channel plate is bonded to the upper surface of the heater plate with the insulative layer therebetween so that a resistive heater element is located in each channel. A portion of the insulative layer over each resistive heater element is removed so that the heater element communicates with ink in each channel. Another portion of the insulative layer is removed so that the ink-supplying fill hole is in fluid communication with all of the channels. See FIG. 2 of Hawkins.

The above-discussed devices attempt to overcome the shortcomings associated with the use of ink jet printheads. With the exception of U.S. Pat. No. 4,369,456, however, all of the devices require movement of the printhead from its operative position for maintenance to be performed thereon. This movement is undesirable as it requires additional moving parts. Such systems are particularly undesirable for use with a full width (pagewidth) printhead. This type of printhead should be held fixed because it is quite large and cumbersome. Additionally, since most of the above-mentioned patents locate the maintenance system adjacent the paper conveying system (e.g., a platen) and require the printhead (which is a carriage-type printhead) to be moved along-side of the paper conveying system, they cannot be practically used with a full width printhead since the printer would have to be made exceptionally wide. Further, since it is required to locate the printhead close to the paper medium for improvement of print quality, it is difficult to locate a maintenance system or a capping member between the printhead and the paper conveying system. Since both the pagewidth printhead and paper conveying system are large, it is not desirable to move them apart from one another to allow a maintenance system or capping member to access the printhead.

While U.S. Pat. No. 4,369,456 utilizes a stationary printhead, the system does not enable a plurality of functions to be performed at a single stationary position of the printhead. Furthermore, the cleaning belt is positioned between the printhead and paper handling system which could result in interference with a printing operation and require additional spacing between the printhead and paper handling system.

Copending U.S. patent application Ser. No. 07/520,740 entitled "An Ink Jet Printer Having a Paper Handling and Maintenance Station Assembly", filed May 9, 1990, the disclosure of which is herein incorporated by reference, discloses an ink jet printer including a full width printhead and a maintenance station for contacting the printhead by moving through at least one opening in a paper handling loop. The opening extends at least the width of the printhead to enable the maintenance station to completely access a front face of the printhead. The relatively large size of the opening, however, could cause inconsistencies in the print quality as the recording medium moves into and out of communication with the printhead front face.

It would therefore be particularly desirable to accurately contact a printhead front face with a maintenance member or capping member without requiring movement of either the printhead or the print medium support and without sacrificing the print quality obtained.

In the thermal ink jet printhead and, in particular, the four-color thermal ink jet printhead, heat management often requires a large costly heat transfer unit (heatsink) to maintain printhead temperature within a desired range by dissipating heat out of the printhead. The use of a fixed printhead would serve to simplify the electrical connections thereto, the ink pathway provided therein and the heat management system connected thereto. These simplifications would lower costs and improve reliability of the printhead.

Full width or pagewidth printheads can generally be divided into two categories: a monolithic approach in which one or both of the heater substrate and channel plate substrate of the printhead are a single large member having a full width or pagewidth size; or a subunit approach in which smaller printhead subunits made from small heater plates and channel plates are combined to form the large extended array having a full width (e.g. the width of a page). For an example of a subunit approach having staggered arrays of printhead subunits, refer to the above-mentioned U.S. Pat. No. 4,829,324 to Drake et al.

An advantage of the subunit approach over the monolithic approach is that a single defective heater element results in the loss of only a subunit instead of the entire full width printhead. For example, prior to assembling a printhead, each heater element is checked to see if it is operating properly. A defective heater element in a monolithic heater plate results in the entire heater plate being discarded whereas only the heater plate subunit is discarded when using the subunit approach. Thus the yield of heater plates is greatly increased by using the subunit approach. A similar advantage of the subunit approach involves the ability to replace individual subunits which have worn out. When too many heater elements have worn out in a monolithic printhead, the entire printhead must be replaced, whereas only the printhead subunits need to be replaced when the subunit approach is sued. A particular advantage of the staggered array subunit approach is the ease with which individual subunits can be removed therefrom. Therefore, the staggered array subunit approach may give a much higher yield of usable subunits if they can be precisely aligned with respect to one another. The assembly of a plurality of subunits requires precise individual positioning in both the X-Y-Z planes as well as precise angular positioning in these planes. The alignment problems for these separate units has heretofore presented quite a formidable task, making this type of large array very expensive to manufacture.

OBJECTS AND SUMMARY OF THE INVENTION

It is an object of the present invention to provide a capping member or maintenance member which can perform operations on a staggered array printhead without moving the printhead.

It is another object of the present invention to provide a capping or maintenance member which can perform operations on a staggered array printhead while the printhead is in its printing position.

It is another object of the present invention to provide a capping or maintenance member for a full width staggered array printhead without requiring movement of the printhead or the recording medium conveying system.

It is another object of the present invention to provide a capping or maintenance member for an ink jet printhead which can perform multiple operations on a full width staggered array printhead such as priming, spitting, wiping, sumping and single-jet priming without requiring any special movement of the printhead or the recording medium conveying system.

It is another object of the present invention to provide a capping or maintenance member which accurately contacts a printhead.

It is another object of the present invention to provide a capping or maintenance member which self-positions itself into engagement with a printhead.

It is another object of the present invention to provide low-cost simplified heat management of a staggered array printhead.

It is a further object of the present invention to provide simplified, high precision assembly of a staggered array printhead.

To achieve the foregoing and other objects, and to overcome the shortcomings discussed above, an ink jet printer is provided which includes a staggered array printhead. Capping and maintenance of front faces of the printhead subunits is performed by self-positioning and self-aligning members which are movably positioned on one side of a recording medium support having staggered openings therein. The locations of the openings correspond to the locations of staggered printhead subunits on an opposite side of the recording medium support. The capping and maintenance members move through the openings to contact the front faces of the printhead subunits.

The staggered array printhead subunits are assembled and bonded to a common substrate using a high precision fixture having spaced recesses located therein and an upstanding wall extending therefrom. The subunits are placed along edges of the recesses and slid into position to abut the upstanding wall. The substrate is then positioned over the subunits to also abut the upstanding wall before being bonded to the subunits.

Heat management of the printhead is provided by an ink manifold which is positioned over the subunits. The manifold includes fingered portions which extend into spaces between the subunits. End surfaces of the fingered portions have sealed openings which bring ink in the manifold into contact with the printhead heat sink.

BRIEF DESCRIPTION OF THE DRAWINGS

The invention will be described in detail with reference to the following drawings in which like reference numerals refer to like elements and wherein.

DETAILED DESCRIPTION OF THE PREFERRED EMBODIMENTS

Figure 1:
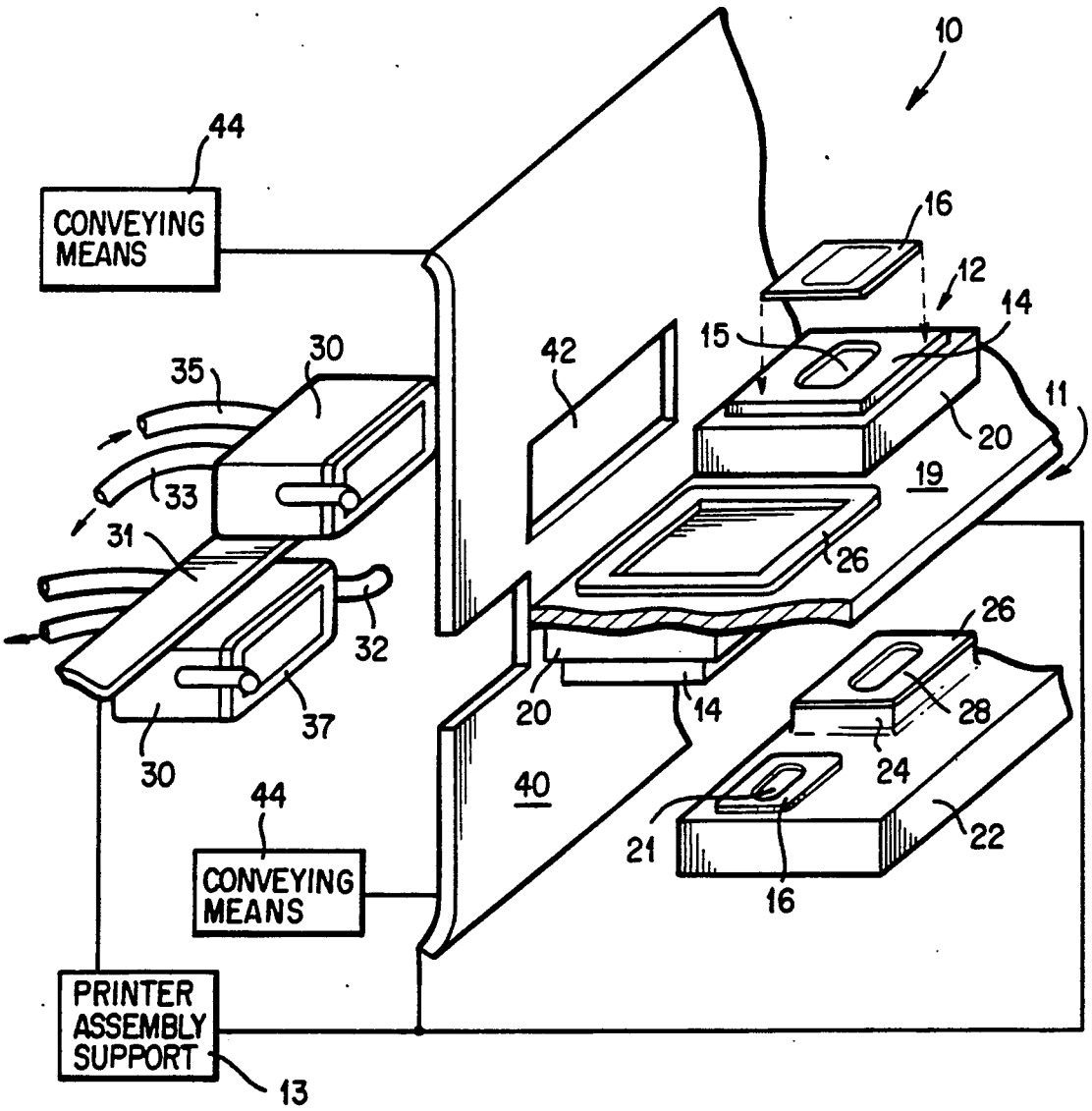
FIG. 1 is a partially exploded view of a staggered array printhead, recording medium support and capping/maintenance members in an ink jet printer.
Figure 2:
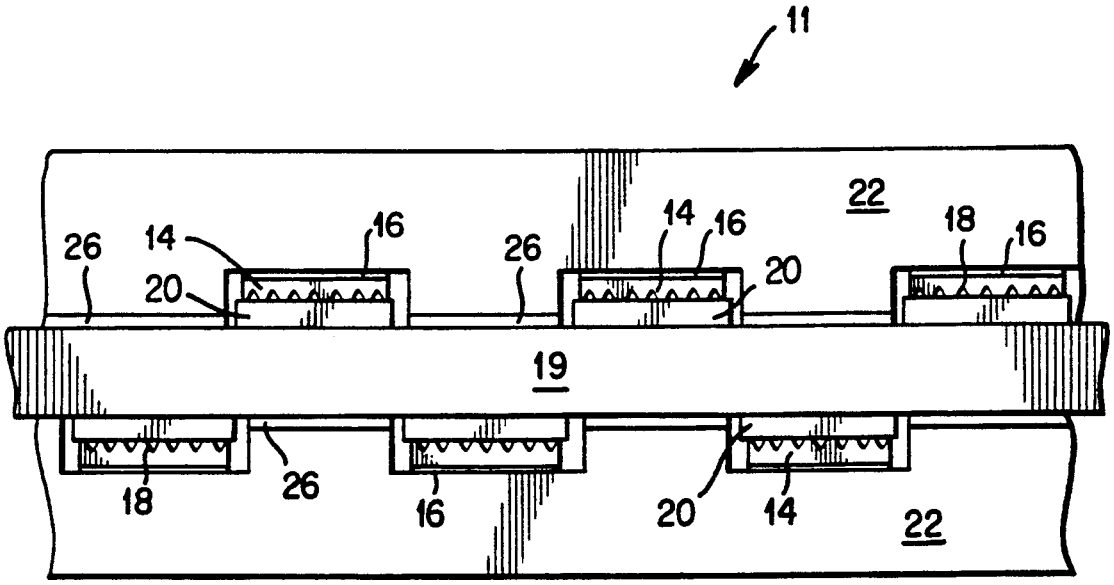
FIG. 2 is a front view of a staggered array printhead according to the present invention.

Referring now to the drawings, and particularly to FIGS. 1 and 2, there is shown in accordance with a preferred embodiment of the present invention an assembly 10 comprising a staggered array printhead 11, a recording medium support 40 and capping/maintenance members 30 which contact the printhead. When the printhead is a full width, i.e., pagewidth, printhead, the printhead is held in a fixed position by printer assembly support 13. Printer assembly support 13 can be, for example, a frame to which printhead 11, recording medium support 40 and capping/maintenance members 30 are attached. Printer assembly support 13 could then be mounted in the printer body (not shown). Alternatively, separate frames could be used to support printhead 11, recording medium support 40 and capping/maintenance members 30 or these components could be attached directly to the printer body.

Staggered array printhead 11 comprises a heat sink substrate 19 having first and second opposed surfaces on which a plurality of printhead subunits 12 are positioned. The printhead subunits 12 are spaced apart on each surface of substrate 19 such that the subunits 12 on the first surface of substrate 19 overlie spaces on the second surface of substrate 19 and the subunits 12 on the second surface of substrate 19 overlie spaces on the first surface of substrate 19. This positioning forms a staggered array of printhead subunits for location close to a recording medium. See for example, U.S. Pat. No. 4,463,359 to Ayata et al, the disclosure of which is herein incorporated by reference.

Figure 3:
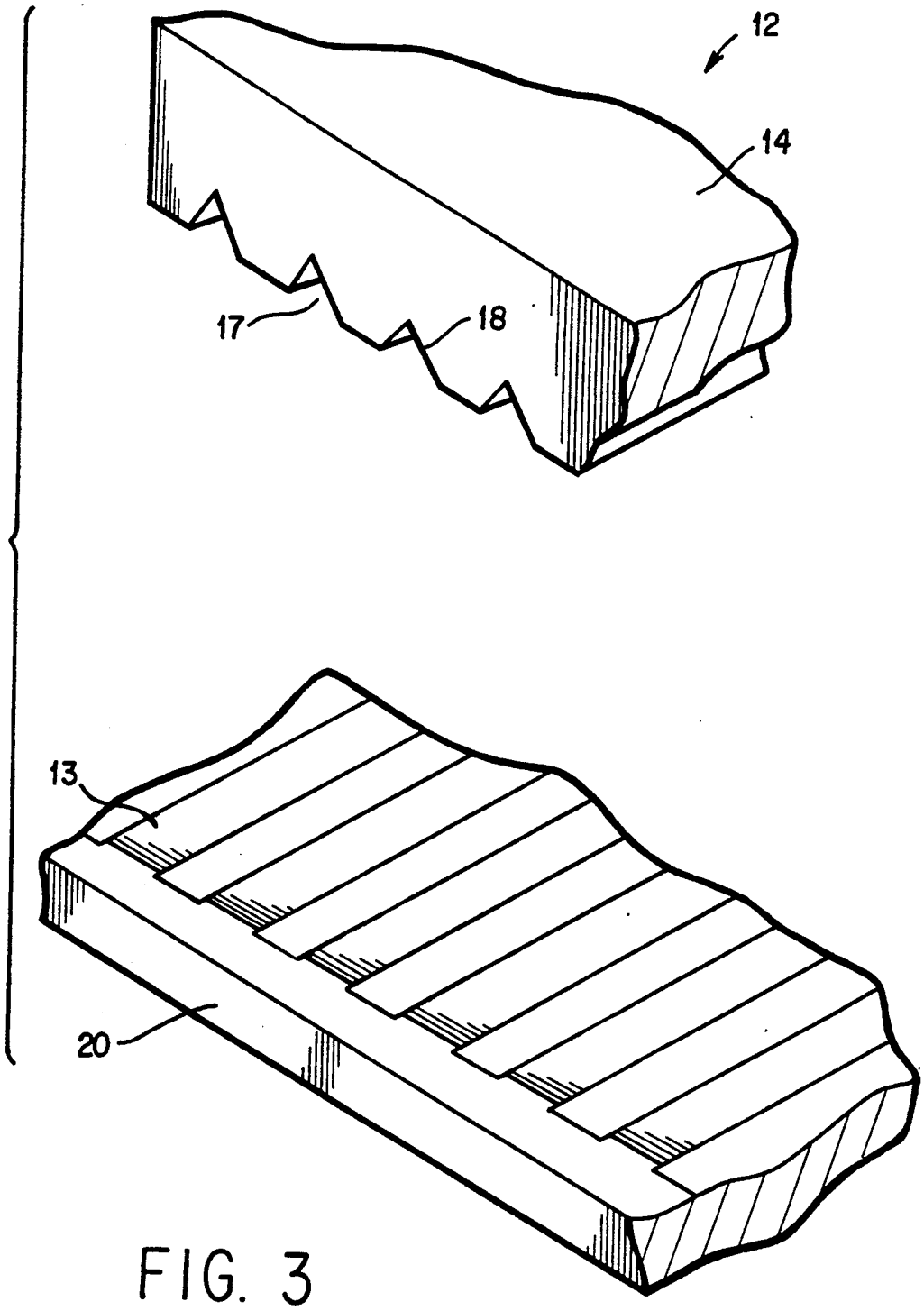
FIG. 3 is a perspective view of a basic printhead subunit of FIG. 1.
Figure 4:
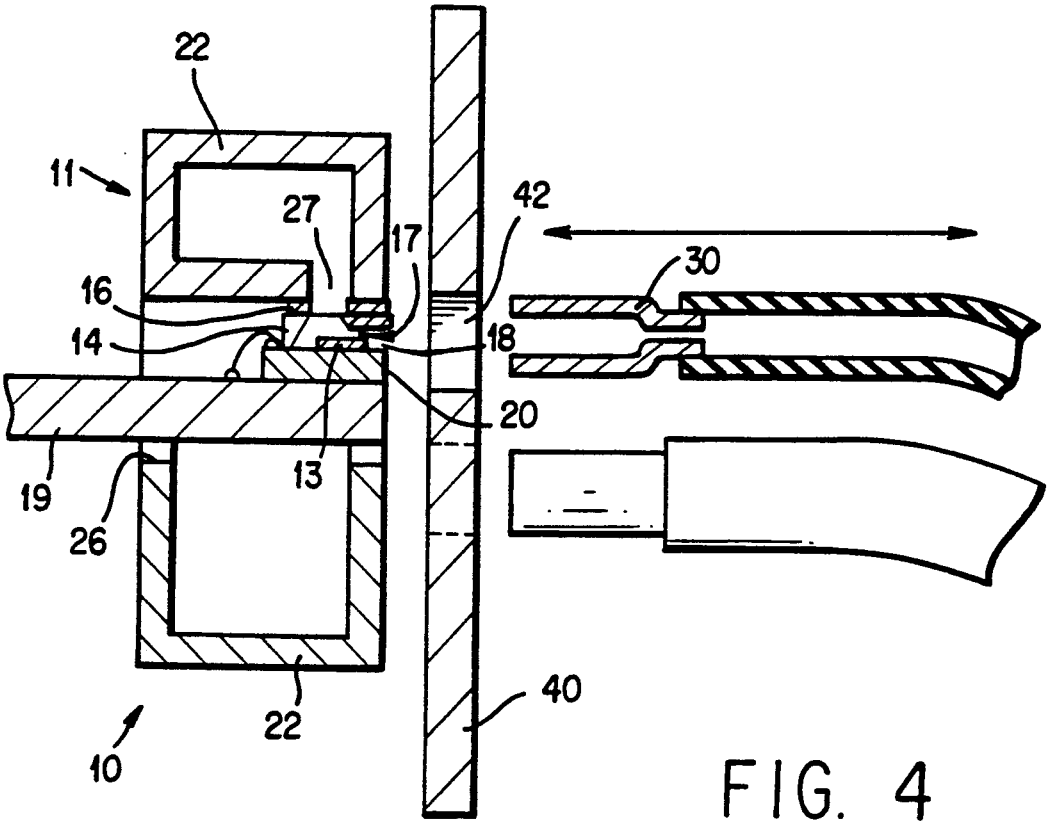
FIG. 4 is a side view of the assembly of FIG. 1.

As shown in FIGS. 3 and 4, each printhead subunit 12 comprises a channel plate 14 having first and second opposed surfaces and a heater plate 20 having first and second opposed surfaces. One surface of channel plate 14 is attached to one surface of heater plate 20. The surface of heater plate 20 to which channel plate 14 is attached has a plurality of resistive heater elements 13 located thereon. The opposite surface of heater plate 20 is attached to substrate 19.

The surface of channel plate 14 which is positioned on heater plate 20 defines ink channels 17 which form nozzles 18 at ends thereof. The opposite surface of channel plate 14 has an ink receiving opening 15 (see FIG. 1) located therein. The heater elements 13 of heater plate 20 correspond in number and position to the ink channels 17 in channel plate 14. Channel plate 14 and heater plate 20 are attached to one another and a dicing action is performed to achieve coplanarity along a front face, nozzles 18 being located in the planar front face. Heater plate 20 preferably extends beyond channel plate 14 along the remaining edges thereof (the side and rear edges). Examples of printhead subunits constructed from small heater plates and channel plates can be found in U.S. Pat. Nos. 4,774,530 to Hawkins and 4,851,371 to Fisher et al, the disclosures of which are herein incorporated by reference.

An ink manifold 22 is positioned on the subunits 12 located on each of the surfaces of heat sink substrate 19. Each ink manifold includes fingered portions 24 which extend into the spaces between subunits 12. The fingered portions 24 each have an extreme surface defining an opening 28 therein. The extreme surface is located in close proximity to the surface of heat sink substrate 19 between each subunit 12. A seal 26, preferably formed of an elastomeric material, is positioned between the extreme surface of each fingered portion 24 and the surface of heat sink substrate 19, seal 26 surrounding opening 28 in the extreme surface. Thus, ink within manifold 22 contacts heat sink substrate 19 to aid in dissipating heat from the heat sink. Since ink is more thermally conductive than air (which is what would contact heat sink 19 between each printhead subunit 12 if fingers 24 were not present) more heat is conveyed away from heat sink 19 faster than with conventional ink manifold designs. Additionally, since all of the ink within manifold 22 eventually becomes heated, the entire ink manifold 22 functions as heat sink. This permits the size (and thus weight and cost) of heat sink 19 to be reduced.

Each manifold 22 further includes openings 27 located above the ink receiving opening 15 of each channel plate 14. Manifold opening 27 and ink receiving opening 15 provide communication between an interior of manifold 22 and an interior of each printhead subunit 12. A seal 16 surrounds ink receiving opening 15 of each printhead subunit 12, seal 16 being positioned between manifold 22 and subunit 12. Seal 16 is preferably formed of an elastomeric material. Manifold opening 28 made as large as possible and is preferably larger than manifold opening 27.

A recording medium support 40 connected to a conveying means 44 operates to properly position a recording medium on which ink is to be deposited closely adjacent to the front face of printhead 11. The conveying means 44 could comprise, for example, a supply roll and a takeup roll having recording medium support 40 in the form of a flexible endless web positioned thereabout. Conveying means 44 could alternatively comprise a drum which rotates about a shaft in a particular direction. The surface of the drum could be provided with recording medium support 40 which presents the recording medium such that ink from printhead 11 is deposited thereon. As a third alternative, recording medium support 40 could be stationary, the recording medium being conveyed between support 40 and printhead 11 by a paper conveying means (not shown).

Figure 5:
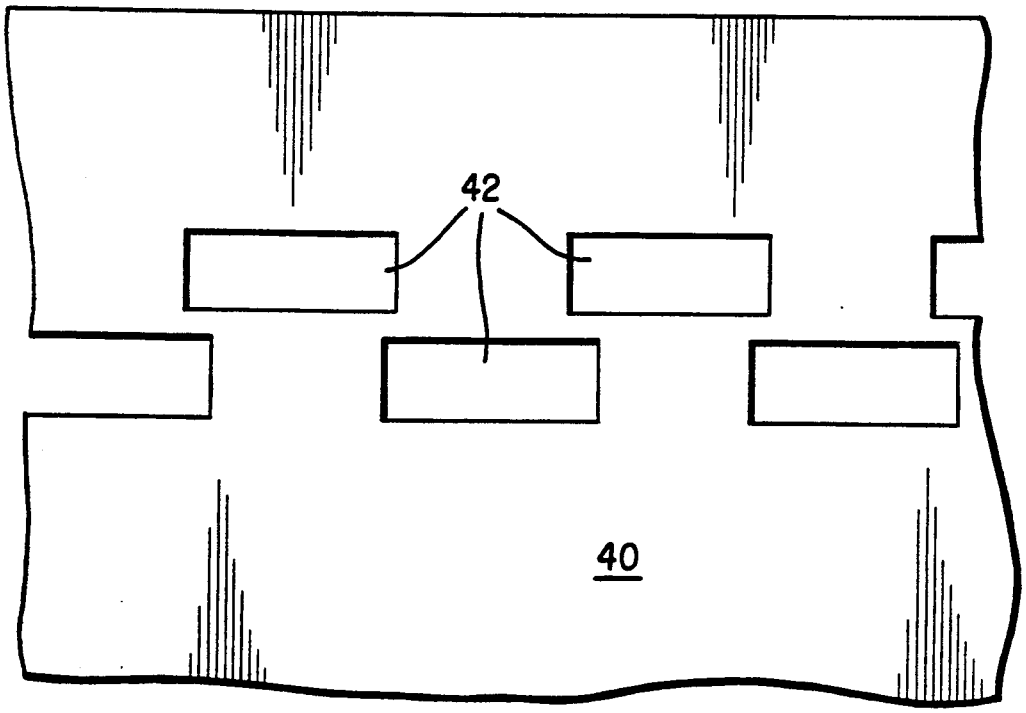
FIG. 5 is a plan view of the recording medium support of FIG. 1.
Figure 6:
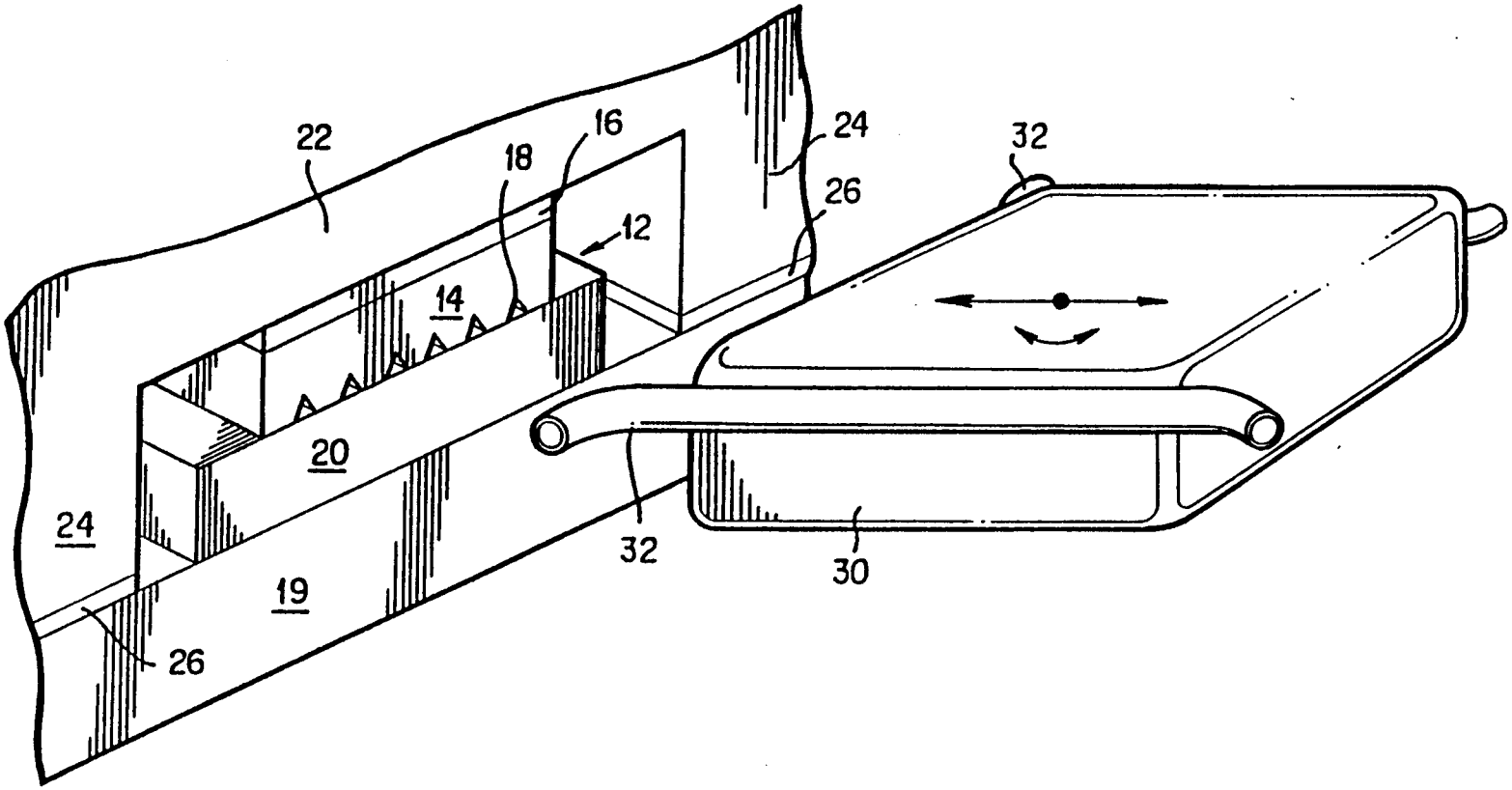
FIG. 6 is a perspective view of a capping/maintenance member for contacting a printhead subunit.

Recording medium support 40 has first and second opposed sides and a plurality of staggered openings 42 provide therethrough. Printhead 11 is located close to a first side of recording medium support 40. Staggered openings 42 as illustrated in FIG. 5 correspond in number and location to the printhead subunits 12 on heat sink substrate 19.

At least one capping and/or maintenance member 30 is provided on the second side of recording medium supports 40. At least one member 30 is provided for each printhead subunit 12. Each member can perform a selected service or a variety of services on the front face of a printhead subunit 12. A capping member is used to cap nozzles 18 during non-use and prevent ink in the nozzles 18 from drying. A priming member draws new ink from manifold 22 into channels 17 and removes whatever substances were there before: old ink, debris, air bubbles, and/or contamination. The primary member also by this process fills the previously empty (at installation or as a result of misfunction) channels 17 with ink. After priming, a spitting or sump member could be used to clear excess ink from nozzles 18. The spitting process comprises maintenance drop ejection initiated by the printhead actuator used to issue drops during printing. The ejection of these maintenance drops is used to refresh aged ink in the channels, e.g. after long standing, before and after the pirnting task, and between pages. When the same member is used to cap the nozzles and as a spitting member, the ink collected within the member from spitting can provide moisture for humidification of nozzles 18 when capped. The spitting member could be used to accept the maintenance drops at predetermined times. When used as a priming member or as a spitting member, conduits 33 and 35 are provided to remove and supply ink, respectively, to member 30. A wiping member such as, for example, a rubber blade or a porous material can be used to wipe the nozzle-containing front face of each printhead subunit 12 to remove contaminants such as ink and dirt therefrom which tend to adversely affect print quality.

At least one of these members is movably positioned on the second side of recording medium support 40. Each member is sized to move through at least one of openings 42 in recording medium support 40 for contact with the front face of at least one printhead subunit 12. Members 30 can be individually movable towards and away from each printhead subunit 12 or can be mounted on a single support, such as, for example, support bar 31, so that the members for all of the printhead subunits are moved in unison towards and away from all of the printhead subunits in the staggered array. Individual members could be slidably positioned to move through openings 42 in recording medium support 40. A single station could include at least two of the members for each printhead subunit, the station being rotatably and slidably mounted and having the members positioned about a circumference thereof. Rotation of the station would cause a selected one of the members to be presented to an opening 42 in the recording medium support 40 and sliding of the station would cause the member to move through opening 42. Movement of a member 30 enables contact with a printhead subunit 12 for performance of a selected service thereon. Upon completion of the service, member 30 is moved to return to its original position, and the printing process is resumed. Thus, the present invention permits multiple operations to be performed on a printhead 11 without moving the printhead to a special position and without moving printhead 11 and recording medium support apart from each other.

In locating staggered openings 42 of recording medium support 40 to correspond to the positions of printhead subunits 12, relatively small openings are used. The small openings prevent any inconsistencies in the print quality which can occur if the recording medium moves towards and away from the front face of printhead 11 which can happen if one large opening, the size of the entire printhead 11, were used. Thus, the printhead front face can be serviced without requiring movement of either the printhead 11 or the recording medium support 40 and without sacrificing the print quality obtained.

Each member 30 includes a gasket 37 at its most forward portion for sealingly engaging the planar front face around each set of nozzles 18 for each printhead subunit 12. FIG. 4 illustrates the engagement structure used to ensure secure contact between the gasket 37 of each capping and/or maintenance member 30 and a printhead subunit 12. The engagement structure comprises at least two guide members 32, preferably of a resilient material, which are attached to each capping-/maintenance member 30 at opposite side surfaces thereof. The guide members 32 are moved along with member 30 to contact at least two sides of each printhead subunit 12, the subunit sides being adjacent to the front face of the subunit 12. Guide members 32 thus provide self positioning of member 30 into secure and accurate engagement with a printhead front face. The locations of guide members 32 ensure alignment between the gasket 37 of each member 30 and a subunit 12.

Figure 7:
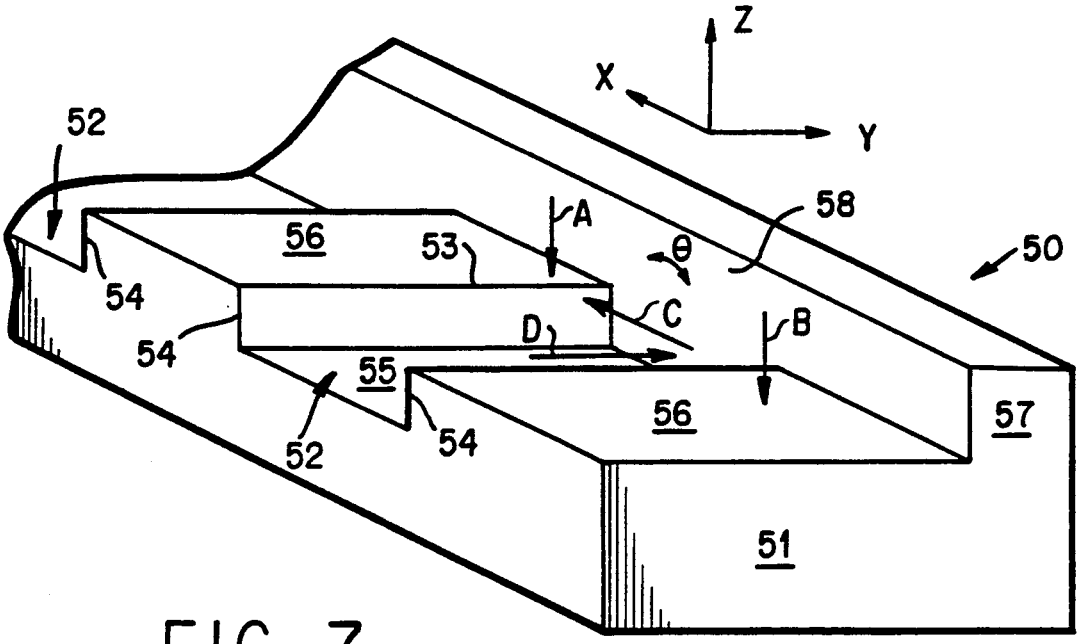
FIG. 7 is a perspective view of a high precision fixture used in the assembly of a staggered array printhead.

FIG. 7 illustrates a high precision fixture 50 used to facilitate the assembly of a staggered array printhead. Fixture 50 has a bottom wall 51 and an upstanding wall 57 extending from a front portion of bottom wall 51. Bottom wall 51 has at least one recess 52, the recess having side walls 54 which are spaced a distance from each other. The distance between side walls 54 is greater than the distance between opposing side surfaces of channel plate 14 and less than the distance between opposing side surfaces of heater plate 20. Recess 52 also has a bottom wall 55. The front and side surfaces and edges of the heater plates 20 and channel plates 14 are essentially planar and straight because they are fabricated using precision dicing and ODE techniques. Thus, if the surfaces and edges of fixture 50 can also be made essentially planar and straight, and a plurality of recesses 52 can be precisely located in fixture 52, each printhead subunit 12 in the full width array will be located with precision relative to each other. Fixture 50 can be made with a high degree of precision by, for example, precisely locating the plurality of recesses 52 in a silicon substrate which makes up bottom wall 51 by using a precision dicing saw or ODE and then bonding a second planar silicon substrate which makes up wall 57 to bottom wall 51. Alternatively, fixture 50 can be made by using electroforming techniques in which case fixture 50 would be made from a metal, such as, for example, nickel.

Assembly of a printhead 11 is achieved by positioning an inverted printhead subunit 12 in at least one recess 52. An edge of channel plate 14 beyond which heater plate 20 extends is positioned against an upper edge 53 of a side wall 54 of recess 52 indicated by arrow C in FIG. 7. The extensions of heater plate 20 are positioned on an uppermost surface 56 of the bottom wall 51 of the fixture 50, indicated by arrows A and B, such that the extensions extend above and beyond the side walls 54 of recess 52. The coplanar front surfaces of heater plate 20 and channel plate 14 which contains nozzles 18 are positioned against a front surface 58 of the upstanding front wall 57 of the fixture 50 indicated by arrow D.

Figure 8:
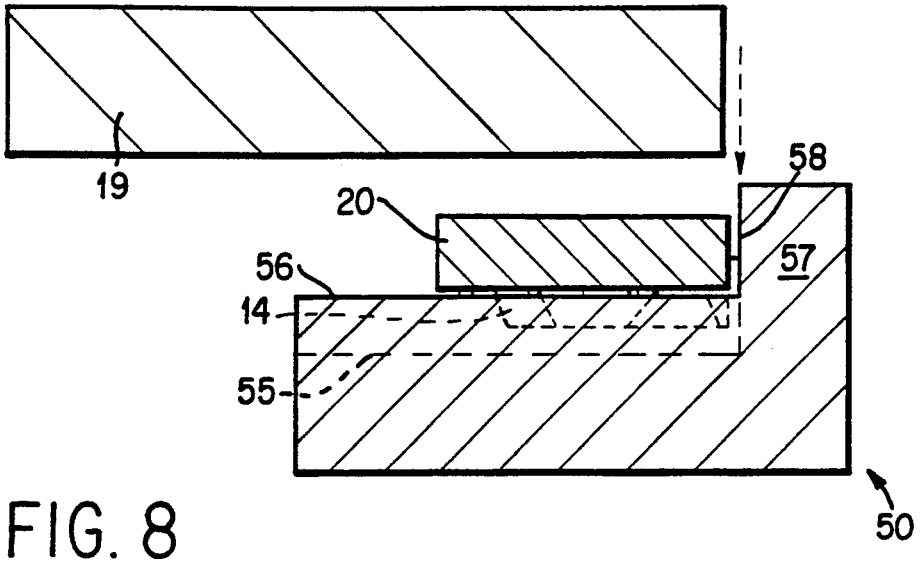
FIG. 8 is a side view of assembly of a staggered array printhead.

As illustrated in FIG. 8, a first surface of substrate 19 is then placed on the surface of heater plate 20 opposite from the surface containing channel plate 14. One side of substrate 19 is positioned against the front surface 58 of upstanding front wall 57 of fixture 50. The surface of substrate 19 positioned on heater plate 20 is then bonded thereto using, for example, a curable adhesive.

By providing a fixture 50 having a plurality of spaced recesses 52 and positioning a printhead subunit 12 in each recess, a printhead 11 having a plurality of subunits 12 attached to a single substrate 19 can be assembled. Movement of subunits against planar surfaces 56 aligns the subunits in the Z-axis direction. Movement of subunits against planar surfaces 54 aligns the subunits in the X-axis direction and movement of subunits against planar surface 58 aligns the subunits in the Y-axis direction. Additionally, since the nozzle-containing surface of each subunit 12 and surface 58 are planar, all of the subunits will be properly aligned in the 0 direction. Thus, all of the nozzles 18 will be spaced an equal distance from the recording medium.

A staggered array printhead 11 can further be assembled by providing a second high precision fixture 50 having a plurality of recesses 52 located therein. Printhead subunits 12 would likewise be positioned in each recess 52. The opposite surface of substrate 19 would then be placed on heater plates 20 of the second fixture 50 so that the printhead subunits 12 on the second fixture 50 are staggered relative to the printhead subunits 12 bonded to the first surface of substrate 19. The side of substrate 19 which was positioned against the front surface 58 of upstanding front wall 57 of the first fixture 50 would also be positioned against the front surface 58 of the upstanding front wall 57 of second fixture 50 in a like manner. The opposite surface of substrate 19 would then be bonded to the upper surface of heater plate 20 positioned on second fixture 50.

It is thus seen that high precision fixture 50 provides precise individual positioning of subunits 12 in both the X-Y-Z planes as well as precise angular positioning in these planes. Alignment problems do not exist, and the fixture 50 is relatively inexpensive to manufacture.

While this invention has been described in conjunction with specific embodiments thereof, it is evident that many alternatives, modifications and variations would be apparent to those skilled in the art. For example, fixture 50 could be used in assembling any large array printhead. The printhead subunit could include any type of actuator plate and does not necessarily require a heater plate. For example, an actuator plate having piezoelectric elements instead of resistive heater elements could also be used. Accordingly, the preferred embodiments of the invention as set forth herein are intended to be illustrative, not limiting. Various changes may be made without departing from the spirit and scope of the invention as defined in the following claims.

What is claimed is:

1. A staggered ink jet printhead array comprising:

a heat sink substrate having first and second opposed surfaces;

a plurality of printhead subunits positioned on each substrate surface;

each printhead subunit having an upper surface, a lower surface and a front surface, a plurality of nozzles being located on said front surface, said lower surface being attached to said substrate and said upper surface having an ink-receiving opening in fluid communication with said nozzles;

the printhead subunits being spaced apart on each surface of the substrate, the subunits on the first substrate surface overlying spaces on the second substrate surface and the subunits on the second substrate surface overlying spaces on the first substrate surface;

an ink manifold positioned on the subunits located on each of the substrate surfaces, each ink manifold having openings located above the ink-receiving openings of the printhead subunits, said manifold openings and subunit openings providing communication between an interior of the ink manifold and an interior of each printhead subunit;

each ink manifold further including fingered portions which extend into the spaces between the subunits, the fingered portions each having an extreme surface, each extreme surface being in close proximity to the substrate surface between each subunit.

2. The staggered ink jet printhead array as recited in claim 1 wherein:

each printhead subunit comprises a channel plate having first and second opposed surfaces, the first channel plate surface defining ink channels which form said nozzles at an end thereof and said second surface being said ink-receiving opening, said first channel plate surface having a heater plate positioned thereon, said heater plate having first and second opposed surfaces, said first surface of the heater plate having a plurality of resistive heater elements corresponding in number and position to the ink channels in the channel plate and being attached to the channel plate so that a heater element is located in each channel, said second surface of the heater plate being attached to said substrate.

3. The staggered ink jet printhead array as recited in claim 1, wherein:

said extreme surfaces of the fingered portions of the manifolds have openings therein which provide communication between the interior of each manifold and the substrate surface located between each subunit.

4. The staggered ink jet printhead array as recited in claim 3, wherein:

seals are positioned between the extreme manifold surfaces and the substrate surfaces, said seals surrounding the openings in said extreme manifold surfaces.

5. The staggered ink jet printhead array as recited in claim 4, wherein:

said manifold seals are elastomeric members.

6. The staggered ink jet printhead array as recited in claim 3, wherein:

the ink manifold openings located above the ink receiving openings are smaller than the openings in the extreme surfaces of the ink manifold fingered portions.

7. The staggered ink jet printhead array as recited in claim 1, wherein:

each upper subunit surface has a seal positioned thereon, each subunit seal surrounding said ink-receiving opening of each subunit and further being positioned between said ink manifold and said upper subunit surface.

8. The staggered ink jet printhead array as recited in claim 7, wherein:

said subunit seals are elastomeric members.

9. The staggered ink jet printhead array as recited in claim 1, wherein:

the printhead array is a full-width array.

10. The staggered ink jet printhead array as recited in claim 1, wherein:

said ink manifold is molded to said printhead subunits in situ, a self-sealing contact being formed between said manifold and said subunits.

11. A method of assembling a printhead from a substrate and at least one printhead subunit, said at least one printhead subunit including: an actuator plate having upper and lower surfaces, front and back surfaces and first and second side surfaces; said actuator plate also having a plurality of actuator elements on said upper surface thereof; a channel plate having upper and lower surfaces, front and back surfaces and first and second side surfaces; said lower surface of said channel plate having a plurality of channels therein corresponding in number and position to the actuator elements on said actuator plate, the lower surface of the channel plate being bonded to the upper surface of said actuator plate so that an actuator element is located in each channel; said front surfaces of said actuator plate and channel plate being coplanar when bonded together to define a plurality of nozzles corresponding to first ends of said channels; a distance between the first and second side surfaces of said actuator plate being greater than a distance between the first and second surfaces of said channel plate so that the first and second side surfaces of said actuator plate form extensions which extend outwardly beyond the first and second side surfaces of said channel plate, respectively, the method comprising:

(a) providing a first high precision fixture having a bottom wall and an upstanding wall extending from a front portion of the bottom wall, said bottom wall having at least one recess, said recess having side walls spaced a distance from each other, the distance between said recess side walls being greater than the distance between the first and second side surfaces of said channel plate and less than the distance between said first and second side surfaces of said actuator plate;

(b) positioning a printhead subunit in said at least one recess including positioning an edge of the channel plate beyond which the actuator plate extends against an upper edge of a side wall of the recess, the actuator plate extensions being positioned on an uppermost surface of the bottom wall of the fixture and extending above and beyond the side walls of the recess;

(c) positioning the coplanar front surfaces of the actuator plate and channel plate against a front surface of the upstanding front wall of the fixture;

(d) placing a first surface of the substrate on the lower surface of the actuator plate, said substrate having said first surface, a second opposed surface and four sides;

(e) positioning one side of the substrate against the front surface of the upstanding front wall of the fixture; and (f) bonding the first surface of the substrate to the lower surface of the actuator plate.

12. The method of assembling a printhead as recited in claim 11 wherein:

said high precision fixture has a plurality of recesses in the bottom wall thereof, each recess being spaced an equal distance from an adjacent recess, the method further comprising:

repeating steps (b)-(c) to position a plurality of printhead subunits in said plurality of recesses to define an extended array of printhead subunits, each printhead subunit being spaced an equal distance from an adjacent printhead subunit; wherein step (d) includes placing the substrate on the lower surfaces of all of the actuator plates positioned on the fixture; and step (f) includes bonding the first surface of the substrate to lower surfaces of all of the actuator plates.

13. The method of assembling a printhead as recited in claim 11 further comprising:

(g) repeating steps (a)-(c) to provide a second high precision fixture having a printhead subunit positioned in its at least one recess;

(h) placing the second surface of the substrate on the lower surface of the actuator plate positioned on the second high precision fixture so that the printhead subunit positioned on the second surface of said substrate is staggered relative to the printhead subunit bonded to the first surface of said substrate;

(i) positioning said one side of said substrate against the front surface of the upstanding front wall of said second fixture; and (j) bonding the second surface of the substrate to the lower surface of the actuator plate positioned on the second fixture.

14. An ink jet printer for printing on a recording medium comprising:

a staggered ink jet printhead comprising:

a heat sink substrate having first and second opposed surfaces;

a plurality of printhead subunits attached to each substrate surface, each printhead subunit having an upper surface, a lower surface and a substantially planar front face, said lower surface being attached to said substrate, said upper surface having an ink-receiving opening and said planar front face having a plurality of nozzles;

the printhead subunits being spaced apart on each surface of the heat sink substrate, the subunits on the first heat sink substrate surface overlying spaces on the second heat sink substrate surface and the subunits on the second substrate surface overlying spaces on the first substrate surface wherein a staggered printhead configuration is defined;

recording medium conveying means including means for supporting a recording medium in a printing zone, the recording medium having first and second opposed sides, said recording medium support means having a plurality of staggered openings provided therethrough corresponding in number and location to the printhead subunits on said heat sink substrate;

printer assembly support means positioning said staggered printhead on said first side of said recording medium support means close to said recording medium support means so that each printhead subunit is aligned with a corresponding opening in said recording medium support means;

at least one member which performs a selected service on the printhead subunit, said member being positioned on the second side of the recording medium support means and being sized to move through at least one of said openings in the recording medium support means for contact with the front face of at least one of said printhead subunits; and first and second manifolds positioned on the subunits located on each of the first and second substrate surfaces, respectively, each ink manifold having openings located above the ink-receiving openings of each printhead subunit, said manifold openings and printhead subunit openings providing communication between an interior of each ink manifold and an interior of each printhead subunit, each of said first and second ink manifolds further including fingered portions which extend into the spaces between adjacent printhead subunits, the fingered portions each having an extreme surface, each extreme surface being in close proximity to the first and second substrate surfaces, respectively.

15. The ink jet printer as recited in claim 14, wherein:

each printhead subunit comprises a channel plate having first and second opposed surfaces, the first channel plate surface defining ink channels which for said nozzles at an end thereof and said second surface having said ink-receiving opening, said first channel plate surface having a heater plate positioned thereon, said heater plate having first and second opposed surfaces, said first surface of the heater plate having a plurality of resistive heater elements corresponding in number and position to the ink channels in the channel plate and being attached to the channel plate so that a heater element is located in each channel, said second surface of the heater plate being attached to said heat sink substrate.

16. The ink jet printer as recited in claim 14, wherein:

said at least one member is selected from a capping member, a priming member, a spitting member and a wiping member positioned on the second side of the recording medium support means.

17. The ink jet printer as recited in claim 16, wherein:

at least two of said members are provided, each having a separate function, each of said at least two members being provided on a single station, each single station being selectively positioned to move through one of said openings in said recording medium support means.

18. The ink jet printer as recited in claim 16, wherein:

at least two of said members are provided, each member having a separate function, said at least two members being positioned about a circumference of a rotatably and slidably mounted station, rotation of said station causing a selected one of said members to be presented to one of said openings in said recording medium support means and sliding of said station causing the selected member to move through said one opening.

19. The ink jet printer as recited in claim 14, wherein said recording medium support means comprises a flexible endless web positioned about two spaced rollers, one roller comprising a supply roll and the other roller comprising a take-up roll, movement of the rollers causing rotation of the web.

20. The ink jet printer as recited in claim 14, wherein:

said recording medium support means is the outer circumferential surface of a drum, the drum being attached to a rotatable shaft, rotation of the shaft causing rotation of the recording medium support means.

21. The ink jet printer as recited in claim 14, wherein:

said at least one member includes engagement means for providing sealed contact between said printhead subunit front face and said member.

22. The ink jet printer as recited in claim 21, wherein:

said engagement means includes at least two guide members which contact at least two sides of each printhead subunit, said sides being adjacent to the printhead subunit front face.

23. The ink jet printer as recited in claim 22, wherein:

said guide members are resilient.

24. The ink jet printer as recited in claim 14, wherein:

said extreme surfaces of the fingered portions of said first and second manifolds have openings therein which provide communication between the interior of each manifold and the first and second substrate surfaces, respectively.

25. The ink jet printer as recited in claim 24, wherein:

seals are positioned between the extreme manifold surfaces and the first and second substrate surfaces, respectively, said seals surrounding the openings in the extreme manifold surfaces.

26. The ink jet printer as recited in claim 25, wherein:

the manifold seals are elastomeric members.

27. The ink jet printer as recited in claim 24, wherein:

said ink manifold openings located above the ink-receiving openings are smaller than the openings in the extreme surfaces of the ink manifold fingered portions.

28. The ink jet printer as recited in claim 14, wherein:

each printhead subunit upper surface has a seal positioned thereon, each printhead subunit seal surrounding said ink-receiving opening of said printhead subunit and further being positioned between each said ink manifold and each said printhead subunit upper surface.

29. The ink jet printer as recited in claim 28, wherein:

said printhead subunit seals are elastomeric members.

30. The ink jet printer as recited in claim 14, wherein:

the ink jet printhead is a full-width printhead.

31. An ink jet printhead and maintenance assembly for use in an ink jet printer comprising:

an ink jet printhead comprising at least one printhead subunit, the printhead subunit having a substantially planar front face including a plurality of nozzles from which ink droplets are emitted; and at least one member which performs a selected service on the at least one printhead subunit, each said at least one member including engagement means for providing sealed contact between said printhead subunit front face and said member, said engagement means including at least two resilient guide members which contact at least two sides of said at least one printhead subunit, said sides being adjacent to the printhead subunit front face.

32. The ink jet printhead and maintenance assembly as recited in claim 31 wherein:

said at least one member is selected from a capping member, a priming member, a spitting member and a wiping member.

33. The ink jet printhead and maintenance assembly as recited in claim 32 wherein:

at least two members are provided, each member having a separate function, each of said at least two members being provided on a single station, each said single station being selectively positioned to contact the printhead subunit front face.

34. The ink jet printhead and maintenance assembly as recited in claim 32 wherein:

at least two of said members are provided, each member having a separate function, said at least two members being positioned about a circumference of a rotatable station, rotation of said station causing a selected one of said members to be presented for sealed contact with the printhead subunit front face.

35. An ink-supplying manifold for a staggered ink jet printhead having printhead subunits positioned in a spaced manner on a substrate, said manifold comprising:

an elongated member;

said elongated member having a plurality of fingered portions extending therefrom for location in the spaces between individual subunits of a staggered ink jet printhead;

said fingered portions each having an extreme surface, each extreme surface to be positioned in close proximity to a surface of the substrate between spaced subunits;

said elongated member and fingered portions including a hollow interior region from which ink is supplied.

36. The ink-supplying manifold as recited in claim 35, wherein:

said elongated member has member openings for location above ink-receiving openings of printhead subunits, said member openings to provide communication from the hollow interior region of the elongated member to each printhead subunit.

37. The ink supplying manifold as recited in claim 36, wherein:

said extreme surfaces of the fingered portions of the manifold each have openings therein for providing communication from the interior region of the elongated member and fingered portions to the substrate surface between spaced subunits.

38. The ink-supplying manifold as recited in claim 37, wherein:

said member openings are smaller than the openings in the extreme surfaces of the fingered portions.

* * * * *